US010290942B1

(12) United States Patent
Catoiu

(10) Patent No.: US 10,290,942 B1
(45) Date of Patent: May 14, 2019

(54) SYSTEMS, APPARATUS AND METHODS FOR TRANSMITTING AND RECEIVING ELECTROMAGNETIC RADIATION

(71) Applicant: Miron Catoiu, Kitchener (CA)

(72) Inventor: Miron Catoiu, Kitchener (CA)

( * ) Notice: Subject to any disclaimer, the term of this patent is extended or adjusted under 35 U.S.C. 154(b) by 0 days.

(21) Appl. No.: 16/102,860

(22) Filed: Aug. 14, 2018

Related U.S. Application Data

(60) Provisional application No. 62/711,811, filed on Jul. 30, 2018.

(51) Int. Cl.

| | |
|---|---|
| ***H01Q 1/52*** | (2006.01) |
| ***H01Q 3/34*** | (2006.01) |
| ***H01Q 9/04*** | (2006.01) |
| ***H01Q 21/22*** | (2006.01) |

(52) U.S. Cl.
CPC ..... *H01Q 9/0428* (2013.01); *H01Q 1/52* (2013.01); *H01Q 3/34* (2013.01); *H01Q 9/0414* (2013.01); *H01Q 21/22* (2013.01)

(58) Field of Classification Search
CPC .. H01Q 9/0407; H01Q 9/0414; H01Q 9/0421; H01Q 9/0428; H01Q 9/0435; H01Q 9/0478; H01Q 9/045; H01Q 1/52; H01Q 1/521; H01Q 1/523; H01Q 19/02; H01Q 19/028
See application file for complete search history.

(56) References Cited

U.S. PATENT DOCUMENTS

| | | | | |
|---|---|---|---|---|
| 6,147,648 A * | 11/2000 | Granholm | ..... | H01Q 21/065 343/700 MS |
| 7,994,999 B2 * | 8/2011 | Maeda | ..... | H01Q 9/0407 343/700 MS |
| 8,350,771 B1 * | 1/2013 | Zaghloul | ..... | H01Q 9/0435 343/700 MS |

(Continued)

OTHER PUBLICATIONS

Liang et al., "Dual Mode Coupling by Square Corner Cut in Resonators and Filters", IEEE Transactions on Microwave Theory and Techniquies, Dec. 1992, pp. 2294-2302, vol. 40, No. 12.

(Continued)

*Primary Examiner* — Dameon E Levi
*Assistant Examiner* — Jennifer F Hu
(74) *Attorney, Agent, or Firm* — Bereskin & Parr LLP

(57) ABSTRACT

A dual mode patch antenna is described herein. The dual mode patch antenna includes an active patch mounted on a first substrate, the active patch having two orthogonal ports located on corresponding X, Y axes of symmetry intersecting at an axis zero located at a center of the active patch, the two orthogonal ports creating a dual mode coupling vector. The dual mode patch antenna also includes a passive patch positioned on top of the active patch, the passive patch mounted on a second substrate, a ground plane positioned below the first substrate, and a conductive boundary wall defining a boundary around the patch antenna, the conductive boundary wall contacting the ground plane below the active patch. The conductive boundary wall includes a compensating dual mode discontinuity that creates a cancelling vector equal in amplitude to the intrinsic, built-in dual mode coupling vector to improve cross-pol attenuation and/or port-to-port isolation of the antenna.

12 Claims, 11 Drawing Sheets

(56) References Cited

U.S. PATENT DOCUMENTS

| | | | | |
|---|---|---|---|---|
| 2001/0054980 | A1* | 12/2001 | Nakamura | H01Q 9/0435 343/700 MS |
| 2005/0099340 | A1* | 5/2005 | Suzuki | H01Q 1/3233 343/700 MS |
| 2006/0097924 | A1* | 5/2006 | Yegin | H01Q 9/0407 343/700 MS |
| 2010/0328160 | A1* | 12/2010 | Hsu | H01Q 1/521 343/700 MS |
| 2015/0207235 | A1* | 7/2015 | Lee | H01Q 9/0435 343/767 |
| 2018/0191073 | A1* | 7/2018 | Celik | H01Q 9/0428 |

OTHER PUBLICATIONS

Bauer et al., "Axial Ratio of Balanced and Unbalanced FED Circularly Polarized Patch Radiator Arrays", 1987 Antennas and Propagation Society International Symposium, Jun. 1987, pp. 286-289.

Karimkashi et al., "A Dually Polarized Frequency Scanning Microstrip Array Antenna for Weather Radar Applications", 2013 7th European Conference on Antennas and Propagation, Jun. 2013, pp. 1795-1798.

Hu et al., "Broadband Circularly Polarized Microstrip Antenna Array Using Sequentially Rotated Technique", IEEE Antennas and Wireless Propagation Letters, Nov. 30, 2011, pp. 1358-1361, vol. 10.

Gentili et al., "New serially fed polarisation-agile linear array of patches", IEE Proceedings—Microwaves, Antennas and Propagation, Oct. 1998, pp. 392-396, vol. 145, Issue 5.

Salazar, et al., "Low Cost X-Band Dual Polarization Phased Array Antenna: Scanning Performance", Proceedings of the 9th European Radar Conference, Oct. 2012, pp. 425-428.

Karimkashi et al., "A Dual-Polarized Series-Fed Microstrip Antenna Array With Very High Polarization Purity for Weather Measurements", IEEE Transactions on Antennas and Propagation, Oct. 2013, pp. 5315-5319, vol. 61, No. 10.

Ramírez, et al., "Design, Fabrication and measurement of a dual-band circularly-polarized stacked microstrip antenna for Galileo and GPS", Proceedings of the Fourth European Conference on Antennas and Propagation, Apr. 2010.

Di Bari et al., "Dual-Polarized Printed S-Band Radar Array Antenna for Spacecraft Applications", IEEE Antennas and Wireless Propagation Letters, Sep. 15, 2011, pp. 987-990, vol. 10.

Vollbracht, "Understanding and optimizing microstrip patch antenna cross polarization radiation on element level for demanding phased array antennas in weather radar applications", Advances in Radio Science, Nov. 2015, pp. 251-268, vol. 13.

Puzella, et al., "Air-Cooled, Active Transmit/Receive Panel Array", 2008 IEEE Radar Conference, May 2008.

* cited by examiner

SYSTEMS, APPARATUS AND METHODS FOR TRANSMITTING AND RECEIVING ELECTROMAGNETIC RADIATION

CROSS-REFERENCE TO RELATED APPLICATIONS

This application claims the benefit of U.S. Provisional Patent Application No. 62/711,811, filed on Jul. 30, 2018, the contents of which are incorporated herein by reference.

TECHNICAL FIELD

The embodiments disclosed herein relate to systems, apparatus and methods for transmitting and receiving electromagnetic radiation, and more specifically to patch antennas for telecom, radar and other radio frequency-based applications.

BACKGROUND

An antenna or an antenna array is an essential part of many electronic systems that require independent and/or simultaneous transmission and receipt of two orthogonal polarizations. Typically, square planar patch antennas are used in modern telecom or radar systems due to their simplicity, good radio frequency (RF) performance, ease of manufacturing and low cost.

However, when two orthogonal, symmetrically placed ports (unbalanced excitation) are added to such an antenna, or any other antenna capable of sustaining two orthogonal polarizations, the resulting antenna cross-pol attenuation appears degraded to values that are insufficient for most applications (e.g. 20 dB or less). This degradation seems to occur regardless of the approach used to add the two orthogonal ports.

One explanation for this degradation is the presence of higher modes which are impairing the cross-pol attenuation and/or the unbalanced (e.g. different) port impedances, where the unbalance is caused by limited port isolation. It is generally believed that this phenomenon is built-in and cannot be alleviated. As a result, a number of design solutions have been devised to mitigate the degradation. One example design is "balanced" excitation, in which the patch is fed by four symmetrical ports, fed in pairs with opposite (0, −180°) phase.

However, many designs devised to mitigate the degradation come with severe limitations. For instance, the balanced approach adds significant signal loss due to the complexity of the feed network, degrading the overall antenna efficiency to intolerable levels, is sensitive to typical manufacturing errors and adds a frequency dependent phase run-out which further degrades the cross-pol. The 2×2 subarray approach having two-mirrored element pairs (as described in U.S. Pat. No. 6,147,648) does not allow scanning and forbids the synthesis of an arbitrary radiation characteristic or an adaptive antenna.

Other antenna approaches are based on frequency scanning which automatically means that such an antenna exhibits frequency squint which for frequency allocation reasons and/or frequency hopping reasons may be unacceptable.

Modern telecommunication and/or radar systems require an array antenna incorporating a patch design that meet the following requirements over the full system bandwidth:

- Excellent effective radiation efficiency, comparable with a paraboloidal reflector

- Orthogonal dual linear polarization and circular polarization left/right capability
- Good cross-pol isolation in both linear and circular polarizations
- Allows the synthesis of any radiation characteristic (cosecant$^2$, etc.)
- High peak power capability
- No frequency induced squint
- No matching network required (no added loss)

All the above requirements are necessary to replicate the performance of the presently available antennas used in the current systems and to maintain system capabilities. If the array antenna in question is to be applied in the latest system designs (high performance weather radar, demanding space applications, etc.) additional requirements should also be met over the full system bandwidth:

- Electronic scanning ability
- Very high cross-pol attenuation (35-40 dB) in the full system bandwidth (linear and/or CP)
- The cross-pol attenuation is maintained during scanning in principal planes
- No phase run-out of the orthogonal ports over the system bandwidth
- Simple patch design, low cost, tolerant to usual manufacturing accuracy Accordingly, there is a need for improved orthogonal polarization antennas, and in particular, for improved square patch antennas capable of offering broadband high cross-pol attenuation (linear V/H and/or left-right CP) for use in telecommunications, space-borne applications and radar systems, that meet the above requirements.

SUMMARY

According to one aspect, a dual mode compensated patch antenna is described herein. The dual mode compensated patch antenna includes an active patch mounted on a first substrate, the active patch having two orthogonal ports located on corresponding X, Y axes of symmetry intersecting at an axis zero located at a center of the active patch, the two orthogonal ports creating a dual mode coupling vector. The dual mode patch antenna also includes a passive patch positioned on top of the active patch, the passive patch mounted on a second substrate, a ground plane positioned below the first substrate, and a conductive boundary wall defining a boundary around the patch antenna, the conductive boundary wall contacting the ground plane below the active patch. The conductive boundary wall includes a compensating dual mode discontinuity that creates a cancelling vector equal in amplitude to the dual mode coupling vector to improve cross-pol attenuation and/or port-to-port isolation of the antenna.

The compensating dual mode discontinuity may be a notch in the conductive boundary wall or any other 45° compensating discontinuity made with or without the presence of a wall.

The notch may be continuous with the conductive boundary wall and protrudes inwardly from a corner of the conductive boundary wall.

The notch may have a square shape.

The notch may have a non-square shape.

The non-square shape of the notch may counterbalance interactions between neighboring antennas when the dual mode compensated patch antenna is incorporated in a non-square antenna array.

The compensating dual mode discontinuity is located on a 45 degree tilted symmetry axis from the center of the active patch.

The compensating dual mode discontinuity may be made using any electrically conducting structure of any shape having a single axis of symmetry.

The compensating dual mode discontinuity may be positioned relative to the orthogonal ports in such a way to negate direct, intrinsic parasitic dual mode coupling resulting from the two orthogonal ports.

The compensating dual mode discontinuity may be positioned relative to the orthogonal ports in such a way to negate direct, intrinsic parasitic dual mode coupling in the full useful return loss bandwidth of the antenna.

The compensating dual mode discontinuity may be positioned in such a way to negate intrinsic parasitic dual mode coupling, achieve frequency independent, very high cross-pol attenuation levels, including left-right attenuation in circular polarization (CP).

The compensating dual mode discontinuity may be positioned in such a way to negate direct, intrinsic parasitic dual mode coupling, achieve high cross-pol attenuation levels without an increase in loss or decrease in antenna efficiency.

The compensating dual mode discontinuity may be positioned in such a way to negate direct, intrinsic parasitic dual mode coupling, achieve high cross-pol attenuation levels which are maintained when the antenna is used in an antenna array, including in an antenna array having different element spacing X-Y.

The compensating dual mode discontinuity may be positioned in such a way to negate direct, intrinsic parasitic dual mode coupling, achieve a high cross-pol attenuation levels which are maintained when the antenna is used in an electrically scanned (phased) array, when scanning occurs in the principal planes.

The orthogonal ports may be each positioned adjacent to the edge of the active patch.

The orthogonal ports may be positioned relative to the edge of the active patch to offer direct 50 Ohm impedance.

These and other features and advantages of the present application will become apparent from the following detailed description taken together with the accompanying drawings. However, it should be understood that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

Figure 1A:
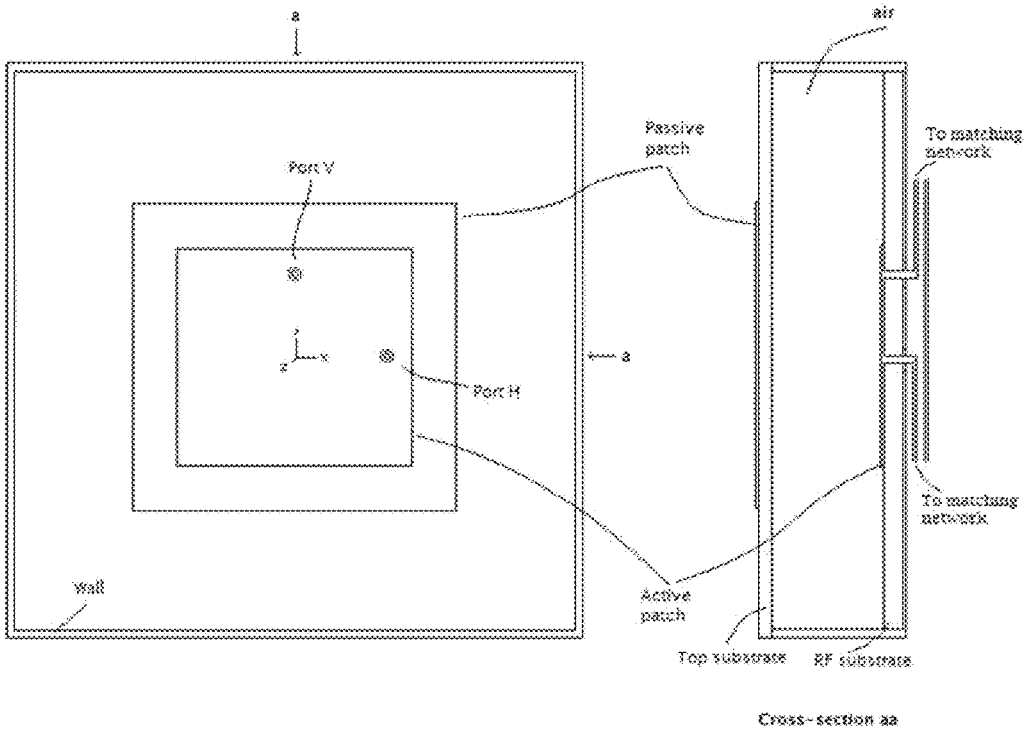
FIG. 1A PRIOR ART
FIG. 1A is a schematic diagram and a cross-section view through the lines a-a of a two patch antenna having two orthogonal ports, according to known prior art.

The skilled person in the art will understand that the drawings, further described below, are for illustration purposes only. The drawings are not intended to limit the scope of the applicant's teachings in any way. Also, it will be appreciated that for simplicity and clarity of illustration, elements shown in the figures have not necessarily been drawn to scale. For example, the dimensions of some of the elements may be exaggerated relative to other elements for clarity. Further aspects and features of the example embodiments described herein will appear from the following description taken together with the accompanying drawings.

DETAILED DESCRIPTION

Various apparatuses and methods are described below to provide an example of at least one embodiment of the claimed subject matter. No embodiment described below limits any claimed subject matter and any claimed subject matter may cover apparatuses and methods that differ from those described below. The claimed subject matter are not limited to apparatuses and methods having all of the features of any one apparatus and method described below or to features common to multiple or all of the apparatuses and methods described below. Subject matter that may be claimed may reside in any combination or sub-combination of the elements or process steps disclosed in any part of this document including its claims and figures. Accordingly, it will be appreciated by a person skilled in the art that an apparatus or method disclosed in accordance with the teachings herein may embody any one or more of the features contained herein and that the features may be used in any particular combination or sub-combination that is physically feasible and realizable for its intended purpose.

Furthermore, it is possible that an apparatus or method described below is not an embodiment of any claimed subject matter. Any subject matter that is disclosed in an apparatus or method described herein that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

It will also be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

It should be noted that terms of degree such as "substantially", "about" and "approximately" as used herein mean a reasonable amount of deviation of the modified term such that the result is not significantly changed. These terms of degree should be construed as including a deviation of the modified term, such as 1%, 2%, 5%, or 10%, for example, if this deviation would not negate the meaning of the term it modifies.

Furthermore, the recitation of any numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation up to a certain amount of the number to which reference is being made, such as 1%, 2%, 5%, or 10%, for example, if the end result is not significantly changed.

It should also be noted that, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

In spite of the technologies that have been developed, there remains a need in the field for improvements in the development of orthogonal polarization antennas, and in particular, square patch antennas capable of offering broadband high cross-pol attenuation (linear V/H and/or left-right CP) for use in telecommunications, space-borne applications, radar systems and the like.

According to one aspect of the concepts, circuits and techniques described herein, there is provided an antenna comprising an active square patch. The active square patch has two orthogonal ports, each located on corresponding X, Y axes of symmetry, where axis zero is located at the center of the active square patch. The active square patch is positioned on a first surface of a metal-clad main radio frequency (RF) substrate of an appropriate thickness. The surface opposed to the substrate (i.e. a second surface) is an antenna ground plane. The two orthogonal ports are provided by two identical via, where a via is a plated trough hole in the substrate, each passing through a small clearance in the ground plane.

A passive patch is placed on a second (i.e. thin) substrate on top of the active square patch. The second substrate is in contact with four conductive walls that define the patch antenna boundary conditions. The walls can be emulated by a multitude of via. The main RF substrate is also in contact with the four walls.

An antenna as described to this point will generally exhibit low cross-pol attenuation and poor port-to-port isolation.

The existence of two unbalanced orthogonal ports, regardless of how they are implemented (e.g. by slot coupling, direct probe, via port, coaxial lines, etc.) create an intrinsic dual mode coupling vector, similar with the coupling vector created in a dual mode filter by a 45° tilted perturbation. This may be because the two orthogonal port entity has an intrinsic axis of symmetry tilted 45° (e.g. in the case of a square patch).

To compensate (i.e. to cancel) the intrinsic dual mode coupling vector that generally occurs in such an antenna (or in any having two orthogonal ports), a conductive discontinuity (also referred to as a compensating dual mode discontinuity) equivalent with an equal amplitude coupling vector is also described herein. The conductive discontinuity provides for both the cross-pol attenuation and the port-to-port isolation of the antenna to be restored to very high values, for instance close to theoretical performance (as described in the Examples section, below).

In some embodiments, the two coupling vectors (e.g. the intrinsic dual mode coupling vector and a cancelling vector) track each other (e.g. they occur in the same plane) in amplitude and phase across the frequency band. This may provide for the very high cross-pol attenuation (~40 dB) to be restored over the full bandwidth of the antenna. As the addition of the cancelling vector may not add additional signal loss, the antennas described herein may retain full radiation efficiency (e.g. which in practice may exceed 92%).

In other embodiments, the antennas described herein may also be squint free, may not require a matching network (e.g. no added loss, the two orthogonal ports have 50 Ohm impedance) and the high cross-pol attenuation of the antennas described herein may be retained when the antennas are used in an array (e.g. a square or rectangular array) and the array is electrically scanned in a principal plane.

It should be noted that while the following description deals mainly with a square patch antenna element that may be implemented in a square or rectangular array, it should be evident to those skilled in the art that the square patch antenna elements may be visualized and constructed into array antennas that have a high degree of symmetry but are not in a square or rectangular shape.

Figures 2A, 2B:
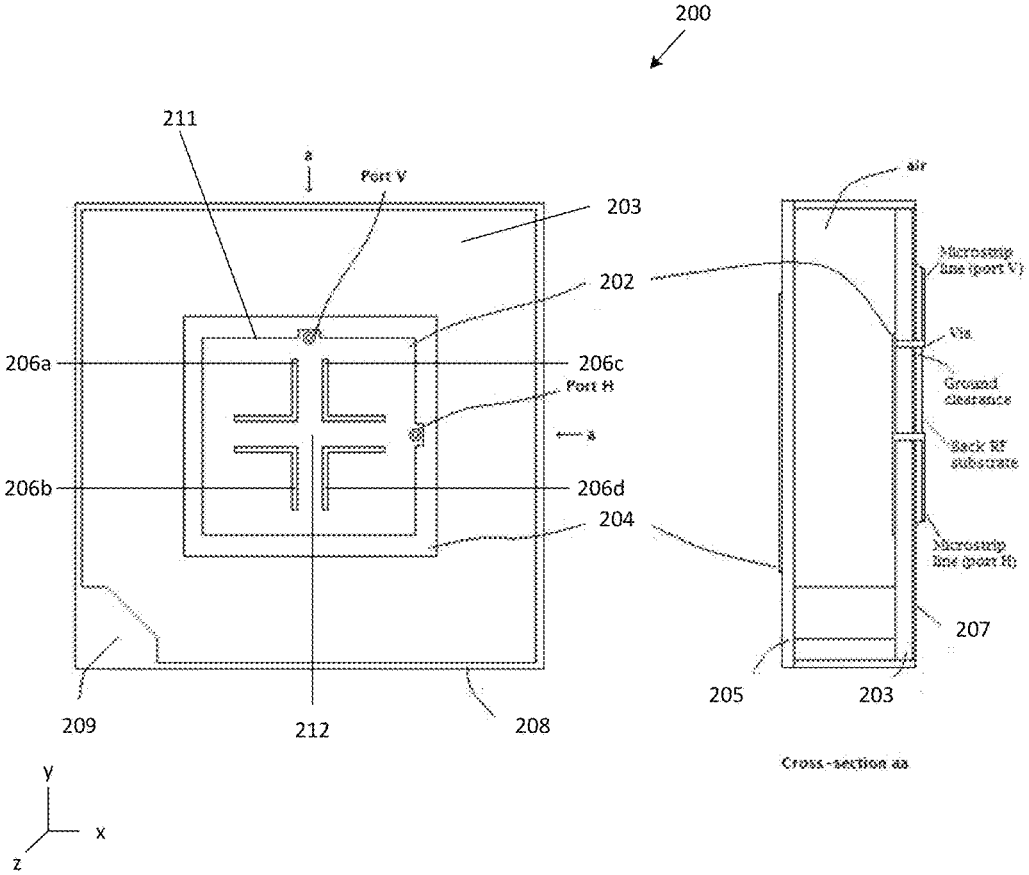
FIG. 2A is a schematic diagram of a patch antenna with two orthogonal ports having implemented dual-mode compensation, according to one embodiment.
FIG. 2B is a partial cross-section view of the patch antenna of FIG. 2A through the line a-a passing through the V and H ports.

Referring to FIG. 2A, illustrated therein is an exemplary embodiment of a square patch antenna 200 that is positioned to intercept a portion of an electromagnetic beam transmitted in a direction z perpendicular to the plane (x,y) of the unit as shown in FIG. 2A, made in accordance with the concepts, circuits and techniques described herein.

Patch antenna 200 includes an active patch 202 positioned on a first (i.e. RF) substrate 203 and a passive patch 204 positioned on a second substrate 205. The passive patch 204 and the second substrate 205 are positioned on top of a top surface of the active patch 202 to form the patch antenna 200.

Active patch 202 generally has a square shape and two orthogonal ports, Port V and Port H, as shown in FIG. 2A. Each port is located on corresponding X, Y axes of symmetry, where axis zero 212 is located at a center of the active patch 202.

Active patch 202 is positioned on a first surface of a first (i.e. RF) substrate 203. First (i.e. RF) substrate 203 is a metal-clad substrate. A thickness of the first substrate 203 depends on an operating frequency (i.e. design frequency) and dielectric constant of the first substrate 203. In one embodiment, antenna 200 may be made using a first substrate 203 having a thickness of 0.813 mm (0.032") of material Rogers 4003. The person of ordinary skill in the art will understand that many other materials exist that are appropriate for first substrate 203.

A second surface of first (i.e. RF) substrate 203 opposed to the first surface is an antenna ground plane 207. Ground plane 207 is generally a sheet of conductive material electrically connected to electrical ground. In some embodiments, the ground plane 207 is made of copper.

Two orthogonal ports are provided in the active patch 202. In the embodiment shown in FIGS. 2A and 2B, the two orthogonal ports Port V and Port H are implemented by two identical via, each passing through the active patch 202, the first (i.e. RF) substrate 203 and a small clearance in the ground plane. Each of the two orthogonal ports Port V and Port H are located adjacent to an edge 211 of the active patch 202. It should be noted that Port V and Port H are located at the same distance from edge 211 of the active patch 202. For example, Port V and Port H are positioned to offer direct 50 Ohm impedance while maintaining very good cross-pol. In some embodiments, the location of the ports Port V and Port H does not require a matching network.

Passive patch 204 is placed on a second (i.e. thin) substrate 205 on a top surface of the active patch 202. The second (i.e. thin) substrate 205 is in contact with a conductive wall 208 that defines the patch antenna 200 boundary conditions. In some embodiments, the conductive wall 208 can be emulated by a multitude of via. The first (i.e. RF) substrate 203 is also in contact with the four conductive walls 208.

Passive patch 204 may be provided with one or more slots that may be of various shapes, for example the L-shaped slots 206 shown in the embodiments in the figures. In the embodiments shown in FIGS. 2A and 2B, passive patch 204 is a slotted passive patch in that passive patch 204 has four L-shaped slots 206*a*, 206*b*, 206*c* and 206*d*, respectively, symmetrically placed around a center of passive patch 204 (e.g. around axis zero 212). The slots 206*a*, 206*b*, 206*c* and 206*d* compensate for the sharp difference in effective dielectric constant seen by the passive patch 204 (i.e. the electric field sees mostly air as a dielectric below top passive patch 204) with respect to the active patch 202. Slots 206*a*, 206*b*, 206*c* and 206*d* may therefore reduce the dimensions of the passive patch 204. It should be noted that the L-shaped slots 206 shown in the figures are only one example shape for the slots 206. In the example of L-shaped slots 206, if each of the L-shaped slots has arms of equal length, the slots 206 do not affect polarization.

As noted above, the antenna 202 is fitted with a conductive boundary wall 208. As shown in FIGS. 2A and 2B, the conductive boundary wall 208 generally has four sides that are generally equally spaced around a perimeter of the substrate 203 to form a square shape. In some embodiments, conductive boundary wall 208 may be metallic. In other embodiments, conductive boundary wall may be a via string.

To cancel the intrinsic dual mode coupling, which appears by default due to the physical via port discontinuity presence, antenna 200 includes a conductive discontinuity. In the embodiments shown in FIGS. 2A and 2B, the conductive discontinuity is embodied as a notch 209 in the boundary wall 208. Notch 209 creates an equal magnitude dual mode coupling vector (e.g. a cancelling vector), canceling the coupling vector generated by the via port presence.

As shown in FIGS. 2A and 2B, notch 209 is generally positioned in a corner of the conductive boundary wall 208. The canceling vector referred to above is achieved by notch 209 protruding inwardly from boundary wall 208. Notch 209 is a metallic, mitered square notch. The cancelling vector is proportional to the dimensions of notch 209. For instance, in the exemplary frames 200 and 300 shown in FIGS. 2A, 2B and 2C, notch 209 and notch 309 are dimensioned to be spaced from the antenna patch.

Generally, notch 209 shown in FIG. 2A is one example of a discontinuity that forms the dual mode canceling vector. Another example of a discontinuity that may form the dual mode canceling vector includes but it not limited to a screw introduced at a 45° angle in the corner of boundary wall 209 or a via array replicating the notch.

Figure 2C:
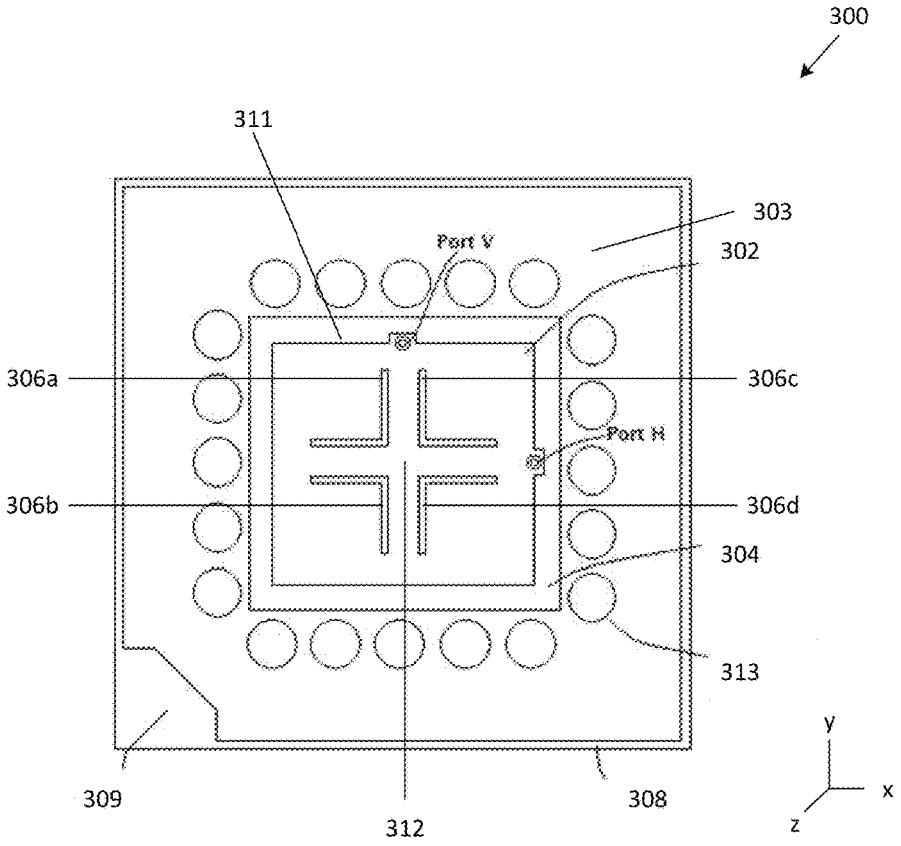
FIG. 2C is a schematic diagram of a patch antenna with two orthogonal ports having implemented dual-mode compensation, according to another embodiment, where the passive patch is made on a low cost non-RF substrate (FR4) and the antenna includes a plurality of clearance holes.

Referring now to FIG. 2C, illustrated therein is an exemplary embodiment of a patch antenna 300 made in accordance with the concepts, circuits and techniques described herein.

Patch antenna 300 includes a plurality of clearance holes 313 in the second (e.g. thin) substrate 305. In this embodiment, the second substrate 305 is designed to minimize cost. For example, in one embodiment, the second substrate 305 is FR4. FR4 is a low cost printed wiring board (PWB) material. However, FR4 has significantly more RF loss than Rogers 4003. Accordingly, the clearance holes 313 remove the lossy material along the patch edges. This provides for the use of a cheap, lossy substrate such as but not limited to FR4 as second substrate 305 with a penalty of only about 0.1 dB in antenna gain, which is insignificant for most applications.

Results

It could be argued that the two coupling vectors (e.g. the dual mode coupling vector and the cancelling vector) can have the same direction on the same 45° tilted axis, so by translation, no cancelling is possible. Generally, this argument misses that the cancelling vector generated by the wall notch 209 is associated with a patch E vector which is opposite in phase (−180°). This means that for the cancelling vector no translation but rotation around an axis normal to the coupling vectors axis must be considered. Hence, cancellation occurs.

To better understand the concepts presented herein, a short discussion is required. As mentioned, above, an antenna having two orthogonal ports (unbalanced excitation) and in particular, a square patch antenna made according to known prior art (FIG. 1A), exhibits poor cross-pol attenuation and poor port to port isolation. This phenomenon is attributed to the presence of higher modes. An argument in favor of this explanation is the fact that E field asymmetry across the antenna patch has been evidenced by probing. The EM simulation also evidences this asymmetry. The simulation shows that if only one port is excited, the zero E field line is not located along the axis of symmetry of the patch (which passes through the isolated port center) but is offset. This directly explains the poor port to port isolation.

Figure 3:
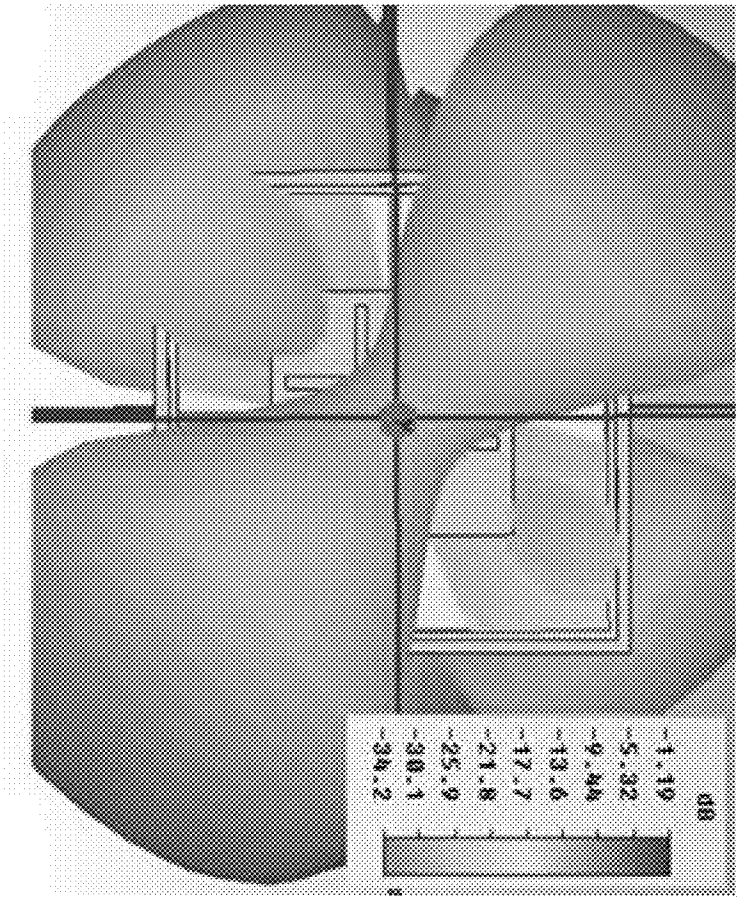
FIG. 3 is a diagram of the inverse axial ratio of the known prior art antenna shown in FIG. 1.

However, both the cross-pol and port-to-port isolation while being poor, are constant across the full antenna bandwidth (within a few 1/10 of a dB), as can be measured in practice. It should be noted that a person skilled in the art will notice that in the case of a microwave circuit in which a parasitic higher mode is present, this is not the case. More, looking at the EM simulation results, it is shown that the inverse axial ratio has an abnormal shape, precisely aligned with a 45° tilted axis (see FIG. 3). The patch dimensions can be altered, top and/or bottom, as long as the two patches remain square and the unbalanced ports are located on the axis of symmetry, the axial ratio remains aligned with the 45° tilted axis over the full antenna bandwidth. A person skilled in the art will recognize that such a behavior of the axial ratio, in the presence of a higher mode, is not possible.

The precise and persistent alignment of the "bad" axial ratio with a 45° tilted axis an important factor. It is known to those skilled in the art that dual mode pass-band filters generally use as a coupling method a 45° tilted perturbation. A dual mode filter uses resonators that support two orthogonal resonance modes having the same mode indices. Generally, no higher mode is involved. The coupling between the two orthogonal modes is made by a 45° tilted conductor.

Figure 1B:
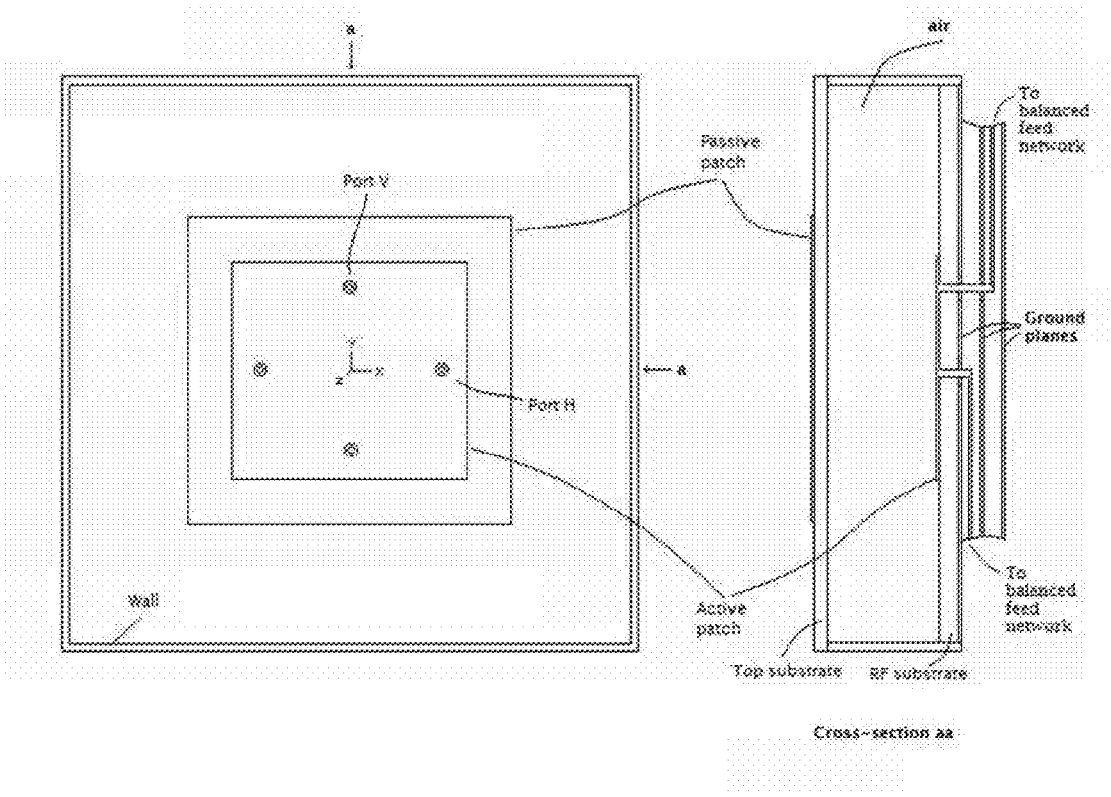
FIG. 1B PRIOR ART
FIG. 1B is a schematic diagram of a two patch antenna, having balanced orthogonal ports, according to known prior art.

Or, a square patch resonator used in any patch antenna is generally a dual mode resonator. Referring back to FIG. 1, it is shown that the only aligned with a 45° tilted axis is the effect of the two port assembly, taken as a single entity. In this example, it was previously believed that if only one port is excited (as is the case when the port-to-port isolation is measured with a network analyzer), the isolated port has no contribution to coupling, and hence the axis cannot be 45° tilted. This appears to be incorrect as it overlooks the E-H vector (RF voltage–current) duality across the patch. When the voltage is maximum at one port, the current maximum occurs at the isolated port disturbance point so the isolated port has an equal contribution to the coupling vector. The result is that the coupling vector is aligned with the axis of symmetry of the two ports, which is geometrically 45° tilted, regardless of port excitations.

Figure 4A:
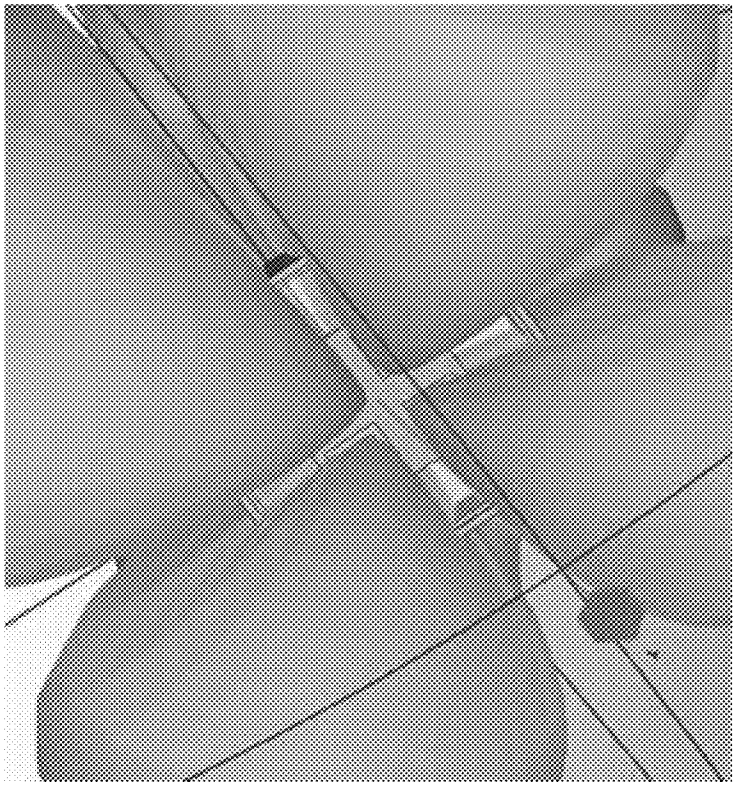
FIG. 4A is a diagram of the inverse axial ratio of the dual mode compensated antenna shown in FIG. 2.
Figure 4B:
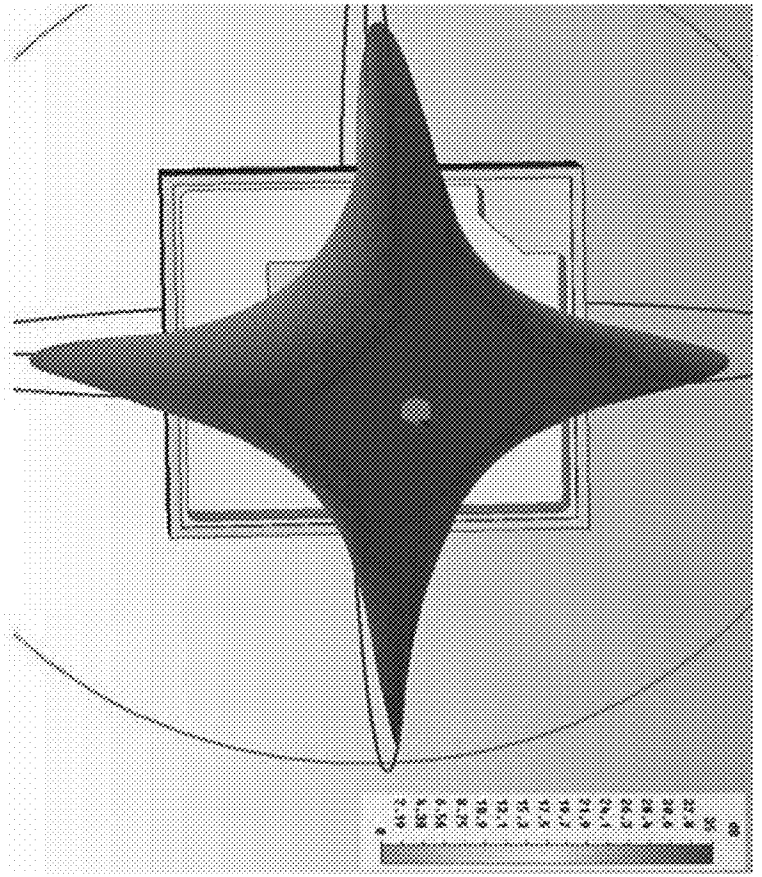
FIG. 4B is a diagram of the high cross-pol level of an antenna made according to the concepts presented in this disclosure.

The excellent inverse axial ratio of the antennas disclosed herein, obtained after the dual mode compensation is implemented, is shown in FIG. 5A. This axial ratio is similar to the axial ratio of an ideal crossed dipole antenna or a patch antenna fed balanced. FIG. 4B also shows why the high cross-pol is maintained during scanning in principal planes.

Referring back to FIG. 2, it is shown that the compensating vector may be created by the addition of the mitered conductive patch. In some embodiments, the mitered conductive patch may be shaped as a square, however the skilled person will understand that the shape of the patch is not restrictive in any way. Any other conceivable shape having one axis of symmetry may be used (such as but not limited to a round shape, a triangular shape, an oval, a maple leaf, two slots, etc.).

It should be noted that small deviations from the 45° symmetry of the compensating shape may be enough to counterbalance the interaction in an unequal X/Y antenna array. For instance, in some embodiments, small deviations from the 45° symmetry of the compensating shape include deviations of less than about 5 degrees. For example, this means that by shaping the notch to have a non-square shape (e.g. rectangular), interactions in a non-square array can be counterbalanced. This feature may be used in the design of an antenna array.

Figure 5:
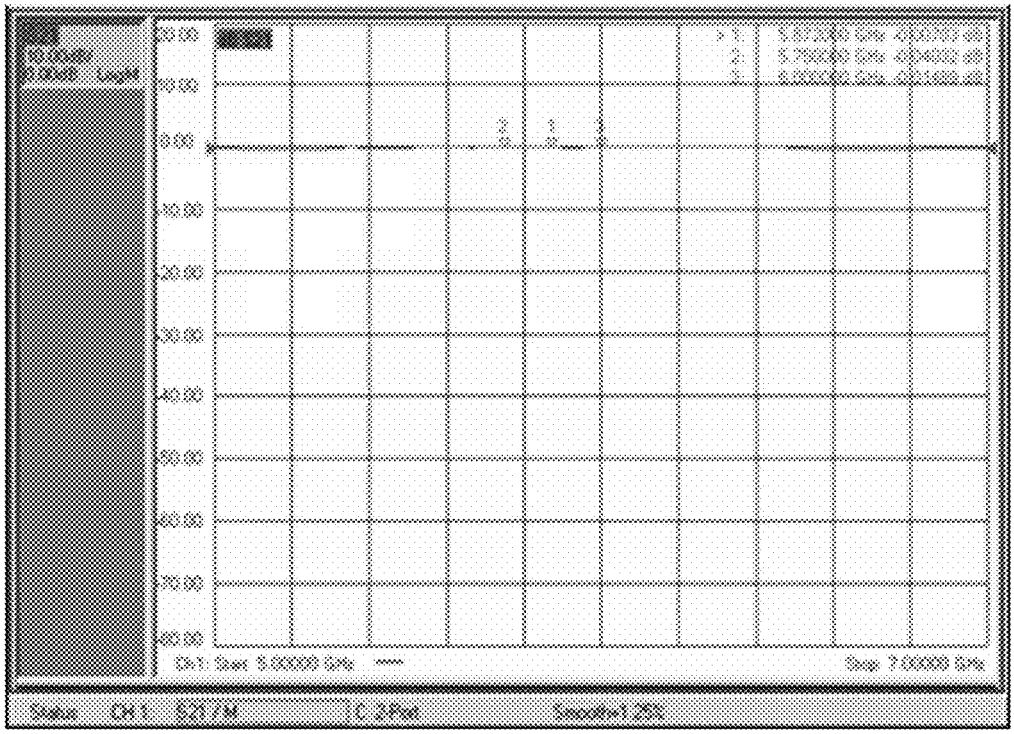
FIG. 5 is a diagram of the measured co-pol reference level of the antenna shown in FIG. 2A.
Figure 6:
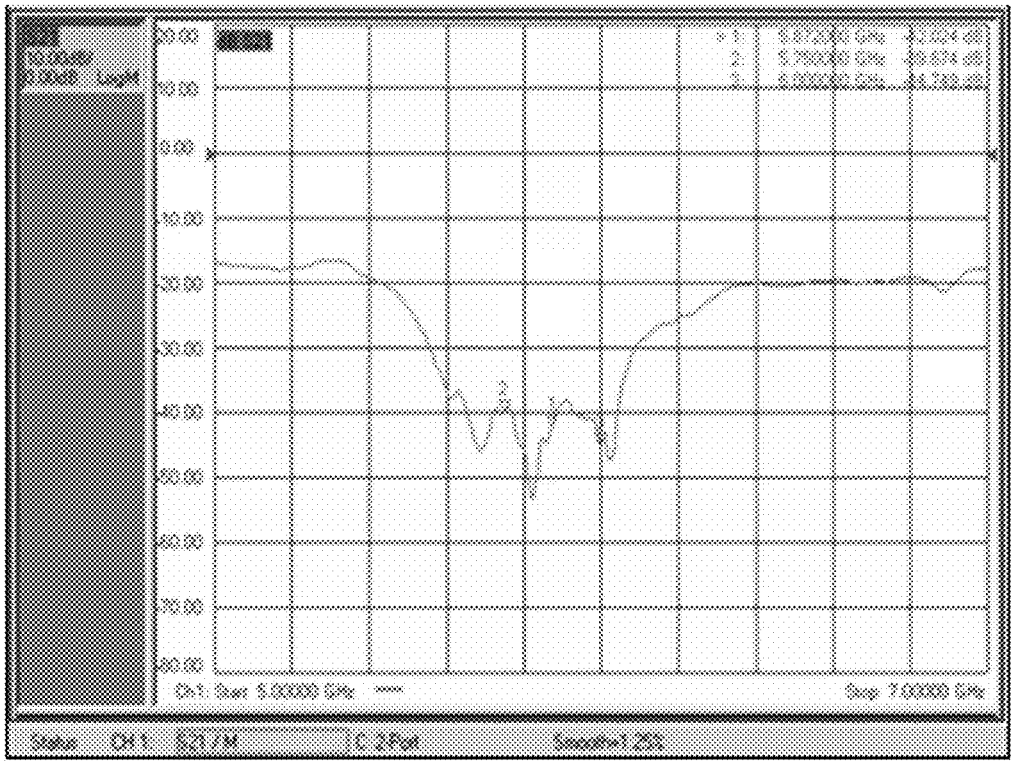
FIG. 6 is a diagram of the measured cross-pol level of an antenna made according to the concepts presented in this disclosure.

The measured co-polar and cross-polar performance of an antenna designed and made according to the concepts presented herein, is shown in FIG. 5 and FIG. 6. It is shown that high cross-pol attenuation is maintained in the full bandwidth of the antenna (over the full useful return loss bandwidth).

The results shown in FIGS. 5 and 6 demonstrate the dual mode compensation concept detailed above. The results shown in FIGS. 5 and 6 also demonstrate that the unbalanced non-symmetric feed method is not limited in the quality of the axial ratio. It should be noted that such a degree of cross-pol attenuation (linear or CP excitation) across the full bandwidth, is equivalent with an amplitude tracking (ellipticity) of better than 0.18 dB and a phase tracking better than 2° across the antenna frequency band.

In some of the embodiments disclosed herein, since transmission starts with an initial (uncompensated antenna) ~20 dB cross-pol attenuation, the dual mode compensating vector needs to be maintained in a window of only ±0.8 dB amplitude and ±5° phase, values which can easily accommodate the typical manufacturing/assembly errors.

Figure 7:
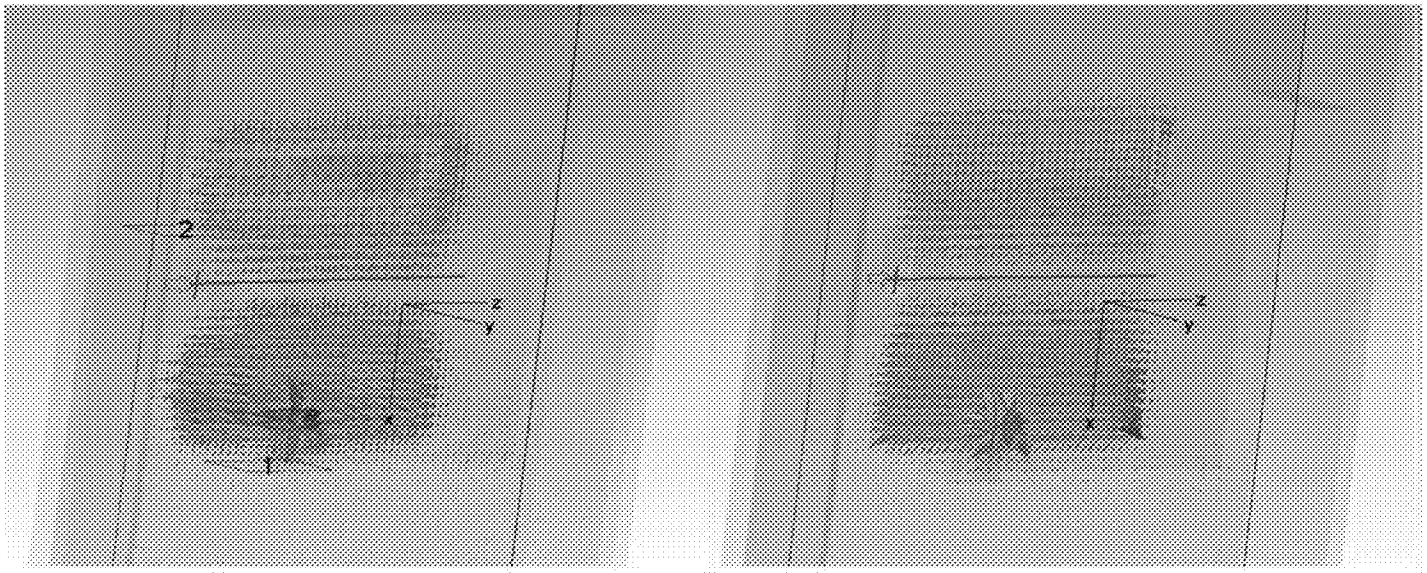
FIG. 7 is a diagram of the E-field distribution across the square patch, before (left) and after (right) the dual mode compensation (only one port is excited).

In at least one embodiment, the antennas described herein demonstrate what a "balanced" excitation circuit really does in a balanced fed antenna: there is no real patch unbalance, just two equal dual mode vectors canceling each other. We can now also see that from the wideband cross-pol attenuation point of view, the "balanced" slot coupling is detrimental as it creates strong parasitic dual mode coupling (strong ground plane current perturbation), approach which is very sensitive to registration errors and the slot coupling also adds further phase errors at frequency band edges. The higher mode argument of E field asymmetry across the antenna patch that has been evidenced by probing and the unbalanced (different) port impedances caused by limited port isolation assumption are in reality a classic example where the end effect was mistaken as the cause. In fact, the simulation shows that once the dual mode compensation is applied, the field symmetry is regained to a high degree (see FIG. 7, right), proving that the initial E field asymmetry was caused by the parasitic dual mode coupling and not higher modes.

Figure 8:
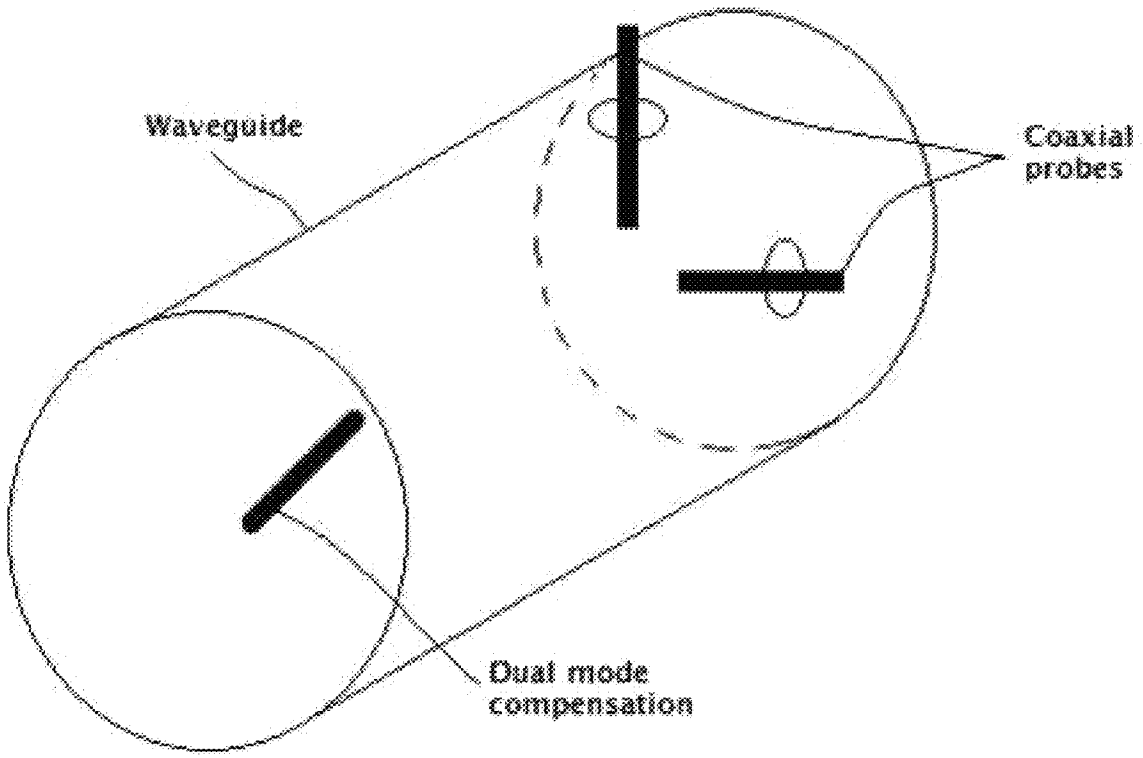
FIG. 8 is a schematic diagram of a round waveguide feed horn having two orthogonal coaxial probes (ports), in which the dual mode compensation is implemented, the according to the concepts presented herein.

This dual mode compensation concept has universal applicability for any antenna having two orthogonal ports, or for any other structure having X/Y symmetry and two orthogonal ports. An example is shown in FIG. 8. Here a waveguide feed horn fitted with two coaxial orthogonal ports is shown. Such a structure may exhibit a very poor port to port isolation due to the strong dual mode coupling induced by the two port (probes) presence. Because in this case there is no benefit from the E field reversal, the addition of a compensating vector in the probe plane is not possible. However, by displacing axially the compensating element, away from the probe plane, so that a virtual −180° compensating vector is created in the port plane, the port to port isolation is restored to high values.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

The invention claimed is:

1. A dual mode patch antenna comprising:

an active patch mounted on a first substrate, the active patch having two orthogonal ports located on corresponding X, Y axes of symmetry intersecting at an axis zero located at a center of the active patch, the two orthogonal ports creating a dual mode coupling vector;

a passive patch positioned on top of the active patch, the passive patch mounted on a second substrate;

a ground plane positioned below the first substrate; and a conductive boundary wall defining a boundary around the patch antenna, the conductive boundary wall contacting the ground plane below the active patch;

wherein the conductive boundary wall includes a compensating dual mode discontinuity, the compensating dual mode discontinuity being a notch in the conductive boundary wall that is continuous with the conductive boundary wall, protrudes inwardly from a corner of the conductive boundary wall and creates a cancelling vector equal in amplitude to the dual mode coupling vector to improve cross-pol attenuation and/or port-to-port isolation of the antenna.

2. The dual mode patch antenna of claim 1, wherein the notch has a square shape.

3. The dual mode patch antenna of claim 1, wherein the notch has a non-square shape.

4. The dual mode patch antenna of claim 3, wherein the non-square shape of the notch counterbalances interactions between neighboring antennas when the dual mode patch antenna is incorporated in a non-square antenna array.

5. The dual mode patch antenna of claim 1, wherein the notch is located on a 45 degree tilted symmetry axis from the center of the active patch.

6. The dual mode patch antenna of claim 1, wherein the notch is made using an electrically conducting structure having a single axis of symmetry.

7. The dual mode patch antenna of claim 1, wherein the notch is positioned on a 45 degree tilted symmetry axis from the center of the active patch, diagonally opposite the two orthogonal ports to negate the intrinsic dual mode coupling vector created by the two orthogonal ports.

8. The dual mode patch antenna of claim 1, wherein the notch is positioned between the active patch and the passive patch to obtain −180 degree phase tracking of the cancelling vector with respect to the intrinsic dual mode coupling vector.

9. The dual mode patch antenna of claim 1, wherein the two orthogonal ports are considered a single disturbance entity that creates the intrinsic dual mode coupling vector.

10. The dual mode patch antenna of claim 1, wherein the orthogonal ports are each positioned adjacent to an edge of the active patch.

11. The dual mode patch antenna of claim 1, wherein the orthogonal ports are positioned relative to an edge of the active patch and offer direct 50 Ohm impedance.

12. An antenna array incorporating the dual mode patch antenna of claim 1.

* * * * *